US007273004B2

(12) United States Patent
Kuhn

(10) Patent No.: US 7,273,004 B2
(45) Date of Patent: Sep. 25, 2007

(54) RECIPROCATING MACHINE

(75) Inventor: Peter Kuhn, Weinheim (DE)

(73) Assignees: Luk Fahrzeug-Hydraulik GmbH & Co. KG, Bad Homburg (DE); Visteon Global Technologies, Inc. MI (US); Obrist Engineering GmbH, Lustenau (AT)

( * ) Notice: Subject to any disclaimer, the term of this patent is extended or adjusted under 35 U.S.C. 154(b) by 354 days.

(21) Appl. No.: 11/004,655

(22) Filed: Dec. 3, 2004

(65) Prior Publication Data

US 2005/0120984 A1 Jun. 9, 2005

(30) Foreign Application Priority Data

Dec. 3, 2003 (DE) ..... 103 56 373

(51) Int. Cl.
*F01B 1/06* (2006.01)
*F16J 1/00* (2006.01)

(52) U.S. Cl. ..... 92/72; 92/181 R; 92/255; 91/491

(58) Field of Classification Search ..... 92/72, 92/129, 158, 181 R, 255; 91/491, 493
See application file for complete search history.

(56) References Cited

U.S. PATENT DOCUMENTS 3,259,074 A 7/1966 Erdmann ..... 103/174
4,128,084 A * 12/1978 Sutherland ..... 91/491

FOREIGN PATENT DOCUMENTS

| | | |
|---|---|---|
| AT | 394892 B | 7/1992 |
| DE | 1 453 663 | 3/1969 |
| EP | 0 088 677 | 9/1983 |
| GB | 2 225 614 | 6/1990 |
| JP | 2-188678 | 7/1990 |

* cited by examiner

*Primary Examiner*—Michael Leslie
(74) *Attorney, Agent, or Firm*—Ladas & Parry LLP

(57) ABSTRACT

The radial piston or reciprocating engine (1) has annularly juxtaposed, radially directed piston-cylinder units (2, 3). The outward stroke of the pistons (2) is controlled by the cam (11) of a common eccentric shaft (12), whereas the inward stroke thereof is controlled by a control ring (16), which engages in a lateral recess (17) of each piston (2) running in the direction of a secant and adapted to a cross-sectional shape of the control ring (16). The recess (17) is then bounded by a base wall of the piston (2) with which the control ring (16) is in controlling sliding contact via an inner control face (20). The pistons (2) are hollow and carry on their face the diaphragm of a diaphragm valve. Thus, the reciprocating engine (1) has a particularly compact construction and can be highly loaded, so that it is particularly suitable as a compressor of a $CO_2$ vehicle air conditioning system.

11 Claims, 4 Drawing Sheets

Figure 1:
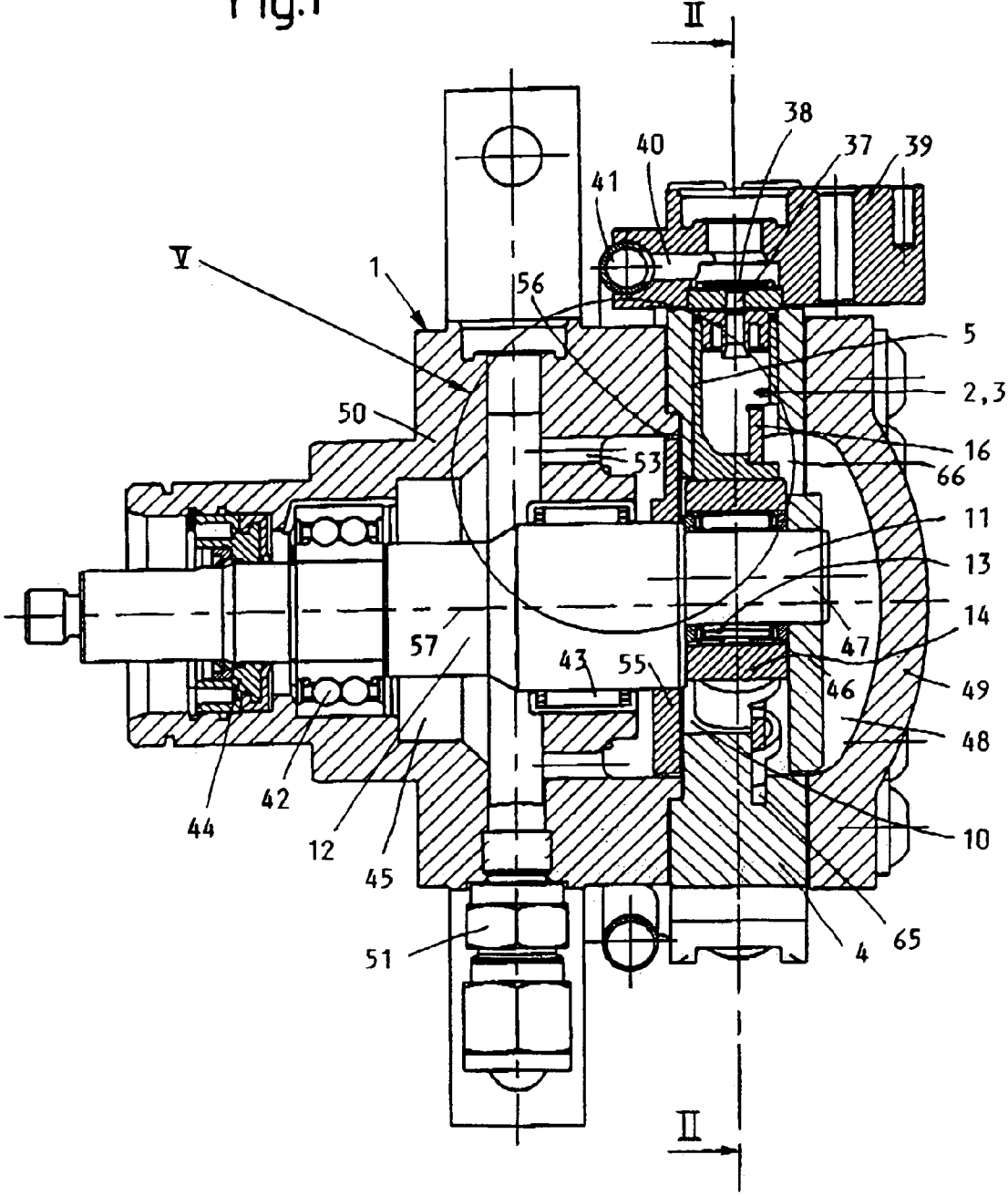

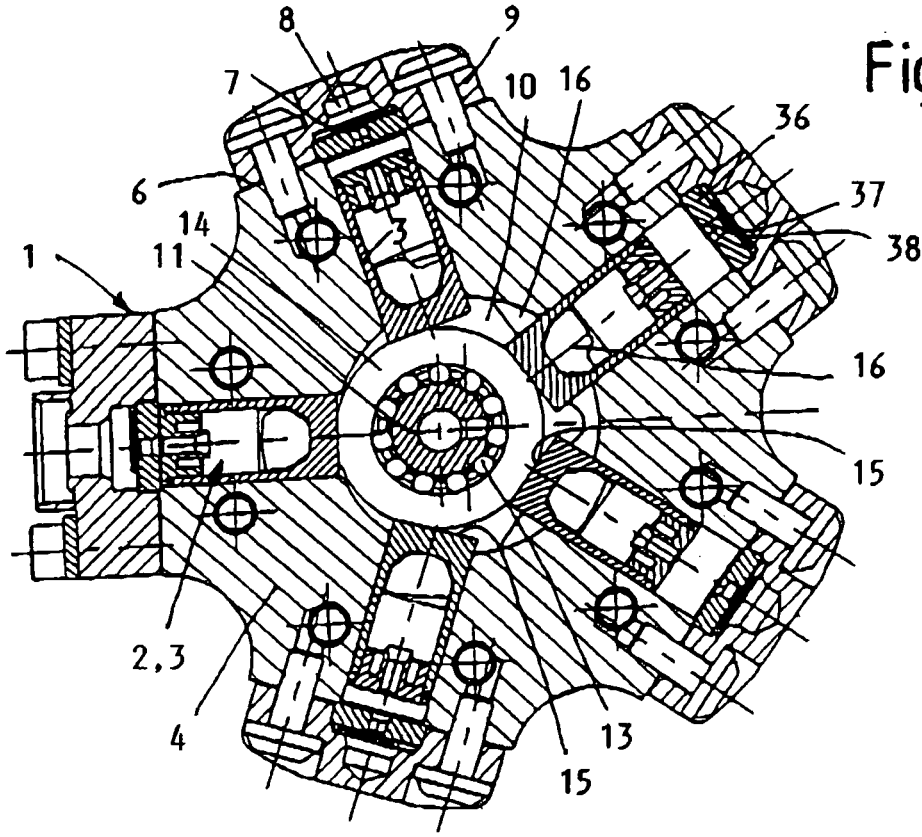
Fig.2
Fig.4
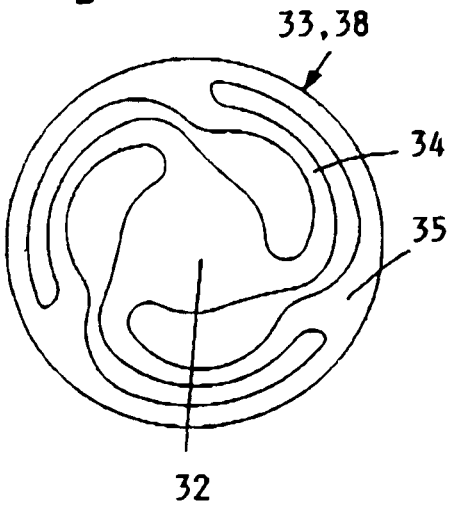
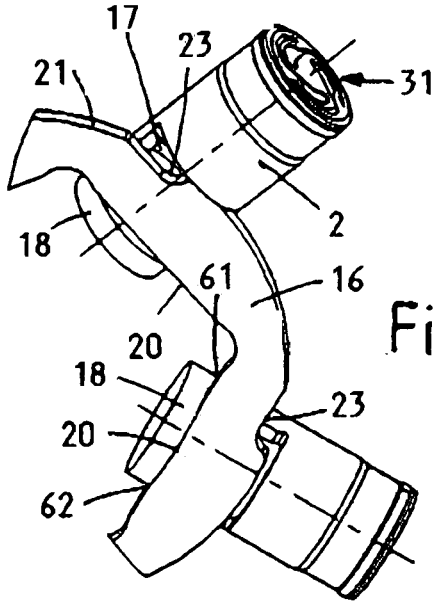
Fig.3

RECIPROCATING MACHINE

The invention relates to a reciprocating or radial piston machine with annularly juxtaposed, radially directed piston-cylinder units and with an eccentric shaft extending through a machine casing body enclosing the cylinders and whose eccentric or cam controls the outward stroke of the pistons, the inward stroke of the pistons being controlled by a common control ring engaging in the pistons.

EP 88677 discloses a reciprocating machine, whose pistons are radially outwardly moved by a cam. In this case only the outward stroke of the pistons is mechanically controlled by an eccentric and by means of a roller bearing embracing the same, whereas the inward stroke takes place through the force of a spring deformed by the stroke movement, so that it keeps the piston in contact with the outer ring of the roller bearing. Such a spring inter alia suffers from the disadvantage that its provision disadvantageously influences the size of the machine. In addition, space acting as a clearance is required for its placing in the cylinder area, in that during the outward stroke an almost complete expulsion of medium is prevented.

GB 2225614 (JP 2188678) discloses implementing the return movement of in each case two facing pistons moved outwards by a cam through a pair of lateral extensions of a coupling ring, which engage with spring preloading and in fork-like manner in a recess of an inner piston end extending into the casing area. Thus, the pistons are not guided over their entire length in the associated cylinders and compact engine construction is prevented by the space required for receiving the coupling ring and the piston ends projecting from the cylinders. In addition, due to the resiliently constructed, lateral extensions of the coupling ring, the engine is only suitable as a pump with a relatively low operating speed.

It is known from AT 394892 to control the stroke movement of mutually annularly arranged pistons solely through a cam, in that the pistons engage in articulated manner by means of a ball end provided on their radially inner end in an annular control body embracing the cam. For the arrangement of the mechanical coupling between the e.g. annular control body embracing the cam and the particular piston, such a piston control has a space requirement preventing a compact construction, linked with a correspondingly complicated construction for the mechanical coupling with the control body.

It is finally known from U.S. Pat. No. 3,259,074 (DE 1453663) to provide for the return movement of pairwise facing pistons a common coupling ring, which laterally engages in a circumferential groove of the pistons. This joint coupling of in each case two equiaxial, facing piston pairs by a single coupling ring is made possible by an engagement allowing its transverse displacement in the second piston pair over four sliding surfaces of the coupling ring arranged at an angle of 90° to one another. For their contact with the cam and the lateral engagement of the coupling ring in the central area of the piston length, said pistons have a relatively large length and correspondingly the machine has a large radial extension. The coupling ring size which codetermines the machine size results from the reception thereof in a large annular channel extending over the entire cylinder block circumference and also required.for the installation thereof. Said annular channel also serves to receive a stop, which is intended to prevent a lateral expulsion of the coupling ring from the piston annular groove. Such an machine is also unsuitable for high operating speeds as a result of the relatively large coupling ring size for which also a construction from wire is provided.

The problem of the invention is to find a reciprocating machine of the aforementioned type which, in the case of a particularly compact construction, requires only relatively few, easily manufacturable and installable components and which also permits, e.g. in a construction as a $CO_2$ air conditioning system compressor, high performance levels at high pressures and with high rotational speeds. According to the invention this problem is solved by the characterizing features of claim 1.

1. Advantageous embodiments of the invention can be gathered from the dependent claims and the following description relative to the attached drawings, wherein show:

FIG. 1 An axial section through a reciprocating machine according to the invention.

FIG. 2 A radial section along line II-II of FIG. 1 enclosing the piston axes.

FIG. 3 A perspective view of two adjacent pistons of the piston arrangement corresponding to FIG. 2 with a circumferential area of the control ring engaging in said pistons.

FIG. 4 A plan view of a valve membrane of check valves provided on the pistons and cylinder heads.

Figure 5:
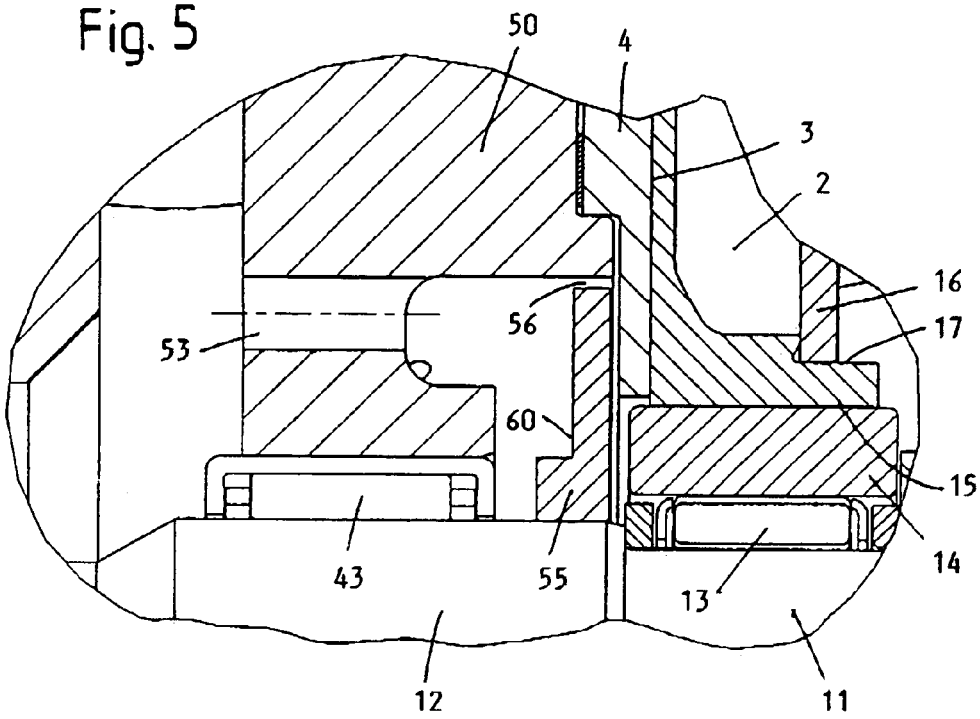

FIG. 5 A larger scale representation from area V in FIG. 1.

Figure 6:
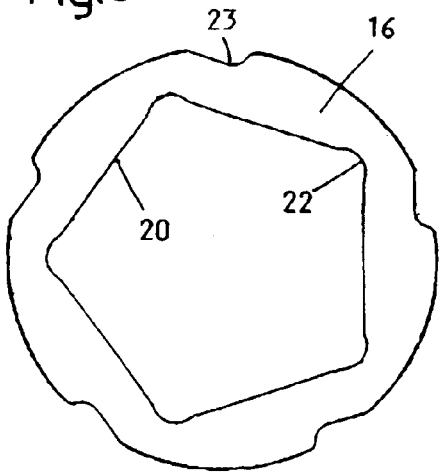

FIG. 6 A side view of the control ring of the reciprocating machine according to FIGS. 1 and 2.

Figure 6A:
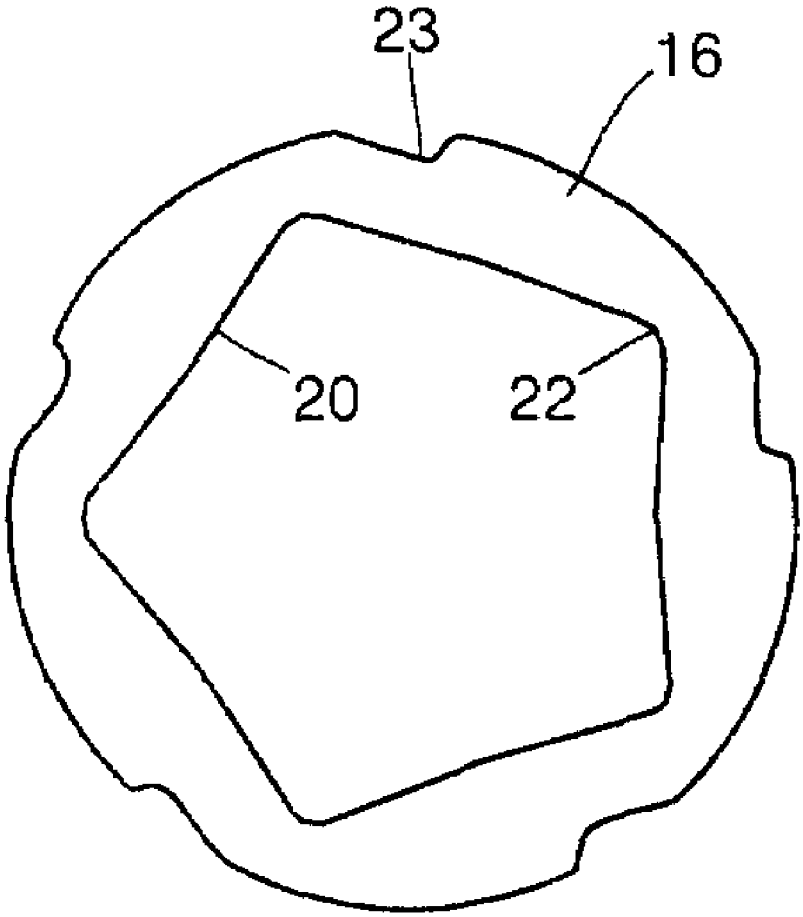

FIG. 6*a* is a side view of an embodiment of the control ring of the reciprocating machine showing it with a slight convex curvature of its inner control faces.

Figure 7:
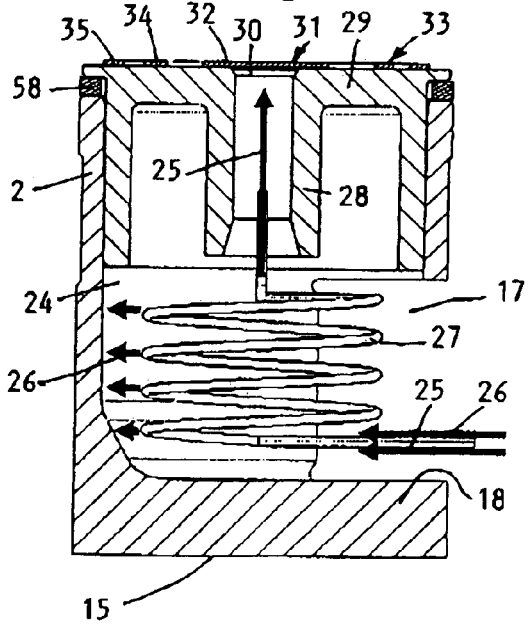

FIG. 7 A larger scale axial section through one of the five pistons of the reciprocating machine according to FIGS. 1 and 2 with a diagrammatic representation of a rotary inflow.

The radial piston or reciprocating machine 1 has preferably an uneven number of (e.g. five) piston-cylinder units 2, 3, which are annularly juxtaposed in a common, relatively shallow body 4 of an machine casing 5, in that in the solid material thereof are formed five radially directed cylinder bores 5 guiding the pistons 2.

In accordance with FIG. 2, in order to save material the casing body 4 is preferably constructed radially and is externally provided with five flange faces 6 for the tight fitting of outlet valves 7 and cylinder heads 9 enclosing an outflow line 8.

Towards the centre of the casing body 4, the cylinder bores 3 terminate in a small, circular gear space 10 arranged centrally with respect to the eccentric shaft 12 and in which the eccentric or cam 11 of the eccentric shaft 12 with a roller bearing 13 embracing the same performs a rotatory movement.

The outer ring 14 of the roller bearing 13, constructed e.g. as a needle bearing, is in constant contact with the inner end face 15 of the piston 2 which faces the same, so that the rotatory movement of the cam 11 in mutually succeeding manner moves the piston 2 radially outwards in order to perform the outward stroke thereof.

in order to drive the pistons 2 in an inward stroke, the five pistons 2 are coupled together by a polygonal control ring 16, that engages each of the pistons 2 in a lateral recess 17 thereof. As a result of such coupling, during the outward stroke of each piston 2 in order corresponding to the rotatory movement of the cam 11, the control ring 16 is drawn outwards and consequently carries with it and draws inwardly the diametrically facing pistons 2, so that they follow their inward strokes in response.

The piston recess 17 is shaped like an indentation guided in the direction of a secant and adapted to the cross-sectional shape of the control ring 16 and consequently has mutually parallel faces. Measured from the inner end face 15 of the pistons 2, the recess 17 has a minimum spacing, which corresponds to the thickness of a base wall 18 of the piston 2, which is preferably constructed with a hollow body. The recess 17 is constructed on a bounded circumferential area of the piston 2 as a lateral interruption of its cylindrical sliding surface sliding in the cylinder 3. This has the advantage that the pistons are guided uninterruptedly in the cylinder 3 over their entire length at least on their larger side not interrupted by the recess 17 and circumferentially having an arc of significantly more than 180Ø.

It is clear that the recesses 17 of pistons 2 and correspondingly the control ring 16, diverging from the embodiment shown, can also be provided on the other side of the casing body 4 facing the casing space 45. Independently of manufacturing costs and the forces acting thereon, the control ring 16 can have different cross-sectional shapes than the disk-shaped construction of the control ring 16 in the embodiment shown, such as e.g. square, so that there is a wider, inner control face 20.

The five inner control faces 20 of the control ring 16 in the embodiment shown pass via a small fillet 22, which serves to better distribute the forces acting on the control ring 16, into the circumferentially following, inner control face 20, so that the control ring 16 has a polygonal, inner contour. A slightly convex curvature of the control faces 20 in the circumferential direction can be advantageous in order to counter act a loading of the terminal boundary edges 61, 62 of the contact faces 18 at right angles to the piston axis. An embodiment of the control ring 16 having a very slight convex curvature of its control faces 20 is depicted in FIG. 6*a*.

As the recess 17 of the pistons 2 is laterally open, the control ring 16 can extend transversely through the pistons 2 and can in unhindered manner perform a transverse movement relative to the piston in this direction and this leads to a control movement taking place in phase with the rotatory movement of the eccentric 11. Its inner control faces 20 slide on the in each case inner base wall 18 of the five pistons 2. In addition, the laterally open recesses 17 of the pistons 2, during machine installation, allow an easy joining together of the movable components.

In order to also secure the control ring 16 in the laterally outward direction in the recesses 17 of pistons 2, during its rotatory movement it slides in a circumferentially constructed clearance 65 of the casing body 4, which is e.g. constructed as a radial indentation. The minimum gear space 10 of the solid casing body 4 is provided, laterally adjacent to the control ring 16, with a circular, circumferential widening 66 corresponding to the size of the control ring 16, which permits its insertion in the integrally constructed casing body 4.

Externally the control ring 16 has five arcuate parts 21 of a cylinder surface, which are in each case bounded by a clearance 23 of the control ring 16. These five clearances 23 in each case form an inflow opening to the cylindrical inner space 24 of the pistons 2 laterally opened through the recess 17. The clearances 23 are positioned in such a way that, in accordance with FIG. 3, they extend over a lateral part of the engagement area of the control ring 16 and consequently the inflow into the piston recess 17 takes place laterally and therefore tangentially into the cylindrical inner space 24 of the pistons 2.

In the cylindrical inner space 27, the tangential inflow in the direction of the double arrows 25, 26 leads to a spiral flow 27 with a centrifugal action, so that a lubricant contained in a gaseous operating medium is retained in the machine 1, as is indicated by the arrows 26 directed counter to the cylindrical inner wall 19 of the piston 2. This centrifugal action is assisted by the outflow of the gaseous medium through a central inner connection 28 of the piston 2, whose central channel issues at the radially outer end face of the piston 2 in a valve opening 30.

The diaphragm 33 of a check valve 31 is fixed by means of its edge 35, e.g. by welding, to the end face of the piston 2. Said diaphragm 33 has a central closing part 32 and three web parts 34 extending therefrom arcuately towards the diaphragm edge 35, so that the web parts 34 form spring elements for the stroke movement of the closing part 32.

The cylinder bores 3 are bounded radially outwards by a plate-like part 36 of the cylinder head 9, which surrounds a central outflow channel 37, against which engages externally the diaphragm 38 of a check valve, which in accordance with FIG. 4, is constructed in the same way as the diaphragm 33 of the check valve provided on piston 2.

From the cylindrical working areas 3 the working medium flows into connection blocks 39, which by means of connecting channels 40, form the connection to a manifold 41 embracing the machine casing 5. By means of the connecting blocks fixed to the outside of the casing body 4 the plate-like parts of the cylinder heads 9 are tightly held under pretension on the casing body 4.

The eccentric shaft 12 is mounted in the machine casing 5 or its bell-shaped casing body 50 by two roller bearings 42, 43. A driveside sealing arrangement 44 seals the casing interior 45 axially with respect to the outside, whereas the free shaft end 47 carrying the cam 11 and a compensating weight 46 terminates in a casing space 48, which is closed by a flanged casing cover 49. The flow of working medium into the reciprocating machine 1 takes place by means of at least one connection 51 connected radially to the bell-shaped, second casing block 50. Then, in accordance with FIG. 5, it flows through the axial channels 53, 54 provided in the casing inner wall 52 and strikes against a baffle plate 55: rotating with the eccentric shaft 11 and where a lubricant fraction in the gaseous operating medium is separated. It then flows round the baffle plate 55 and via a gap 56 between the baffle plate and the casing body 50 to the circular gear space 10 of the casing body 4 arranged centrally to the casing and shaft axis 57 and in which revolves the cam 11, so that the working medium can flow from the terminal casing space 48 in the above-described manner into the pistons 2.

The construction of the check valves for the inflow into the working cylinders 3 and the outflow therefrom as a diaphragm valve and the arrangement thereof directly at the piston 2 allows particularly small radial dimensions and a particularly compact construction of the reciprocating machine 1, which can consequently be operated with high rotational speeds of its cam 11, so that high performance levels are possible. Therefore the reciprocating machine according to the invention is particularly suitable as a compressor for a C02 air conditioning system for installation in the machine compartment of a motor vehicle. In addition, the inventively essential components of the machine are designed in such a way that they can be manufactured and installed in a simple manner.

For ease of manufacture, the pistons 2 comprise two telescopically engaged parts and prior to the joining thereof on one of these parts, i.e. that part having the piston head 29, is fixed the valve diaphragm 33, whereas on the other part the recess 17 is produced by lateral milling. On joining together by press fit they receive a piston ring 58 between them.

A reciprocating machine 1 according to the invention is suitable for high rotational speeds exceeding 10,000 r.p.m., so that the balancing of the eccentric shaft 12 and the components rotating therewith, inter alia through the compensating weight 46 and e.g. a clearance 60 on the co-rotating baffle plate 55 is of particular importance.

The invention claimed is:

1. Reciprocating machine with annularly arranged, radially directed piston-cylinder units (2, 3) and with an eccentric shaft (12) extending through a casing body (4) of an machine casing (5) enclosing the cylinders (3) and having a cam (11) for controlling an outward stroke of the pistons (2), an inward stroke of the pistons (2) being controlled by a common control ring (16) engaging in the pistons (2), characterized in that the engagement of the control ring (16) takes place in a lateral recess (17) of each piston (2) running in a direction of a secant and adapted to a cross-sectional shape of the control ring (16) and which bounds a base wall of the piston (2), the control ring (16) being in controlling sliding contact via an inner control face (20) with said base wall (18).

2. Reciprocating machine according to claim 1, characterized in that the number of piston-cylinder units (2, 3) is odd-numbered, so that the substantially linearly directed, inner control faces (20) of the control ring (16) together form a polygon with a non-right-angled, reciprocal association.

3. Reciprocating machine according to claim 2, characterized in that the inner control faces (20) of the control ring (16) have a convex curvature preventing edge contact with the base wall (18).

4. Reciprocating machine according to claim 1, characterized in that a lateral face of the control ring (16) borders with sliding contact the boundary surface of the recess (17) running in the direction of a secant.

5. Reciprocating machine according to claim 1, characterized in that the recess (17) and therefore the control ring (16) extend by more than half the piston radius into the particular piston (2).

6. Reciprocating machine according to claim 1, characterized in that a clearance (65) forming at least one butting face for the control ring (16) is provided in the casing body (4).

7. Reciprocating machine according to claim 1, characterized in that the pistons (2) are constructed as hollow bodies with a cylindrical inner wall (19), so that the recess (17) provided for the control ring (16) forms a lateral piston opening.

8. Reciprocating machine according to claim 7, characterized in that on its circumferential areas engaging in the recess (17) of the pistons (2), the control ring (16) has in each case a clearance (23), which forms an inflow connection to the inner piston space (24) tangential to the cylindrical piston inner wall (19).

9. Reciprocating machine according to claim 7, characterized in that an inner connection (28) is provided on the piston head (29) and therefore forms a central piston channel issuing at the end face of the piston (2), a diaphragm (33) of a diaphragm valve (31) engaging on said end face.

10. Reciprocating machine according to claim 7, characterized in that the pistons (2) comprise two telescopically engaged parts enclosing between them a piston ring (58) and on one of said parts is provided a central inner connection (28) and a valve diaphragm (33) and the recess (17) is milled laterally in the other part.

11. A reciprocating machine comprising:

a machine casing;

annularly arranged, radially directed, cylinderical, pistons disposed in said machine casing, said pistons being constructed as hollow bodies with a cylindrical inner wall;

an eccentric shaft extending through the machine casing, the eccentric shaft having a cam for controlling outward strokes of the pistons; and a common control ring for controlling inward strokes of the pistons, the common control ring engaging each piston in a lateral recess in the outer circumferential wall of each piston, said lateral recess forming a lateral piston opening and running in a direction of a secant across the outer circumferential wall of each piston and following a base wall of each piston, the control ring being in controlling sliding contact via an inner control face of the common control ring with said base wall.

* * * * *